US010202929B1

(12) United States Patent
Dec et al.

(10) Patent No.: US 10,202,929 B1
(45) Date of Patent: Feb. 12, 2019

(54) ADDITIVE-MIXING FUEL-INJECTION SYSTEM FOR INTERNAL COMBUSTION ENGINES

(71) Applicant: National Technology & Engineering Solutions of Sandia, LLC, Albuquerque, NM (US)

(72) Inventors: John E. Dec, Livermore, CA (US); Ronald F. Renzi, Tracy, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 342 days.

(21) Appl. No.: 14/855,809

(22) Filed: Sep. 16, 2015

Related U.S. Application Data

(60) Provisional application No. 62/053,468, filed on Sep. 22, 2014.

(51) Int. Cl.

| | |
|---|---|
| ***F02D 41/40*** | (2006.01) |
| ***F02D 41/26*** | (2006.01) |
| ***F02D 19/12*** | (2006.01) |
| ***F02M 51/06*** | (2006.01) |
| ***F02M 35/10*** | (2006.01) |

(52) U.S. Cl.
CPC ..... *F02D 41/401* (2013.01); *F02D 19/12* (2013.01); *F02D 41/26* (2013.01); *F02M 35/10216* (2013.01); *F02M 51/0603* (2013.01)

(58) Field of Classification Search
CPC ..... F02D 19/12; F02D 37/02; F02D 41/0025; F02D 41/3011; F02D 41/401; F02B 47/04; F02M 25/14; F02M 2700/12; F02M 2700/43; F02M 2700/4321; F02N 19/001; F02N 2019/002
See application file for complete search history.

(56) References Cited

U.S. PATENT DOCUMENTS

| | | | | |
|---|---|---|---|---|
| 4,050,420 A | | 9/1977 | Cataldo | |
| 4,329,945 A | * | 5/1982 | Beech | F02D 19/12 123/25 B |
| 4,346,689 A | | 8/1982 | Neely | |
| RE31,218 E | * | 4/1983 | Hicks | F02M 43/00 123/1 A |

(Continued)

FOREIGN PATENT DOCUMENTS

| | | | |
|---|---|---|---|
| WO | WO2016000834 | 1/2016 | |
| WO | WO 2016000834 A1 * | 1/2016 | C10L 1/231 |

OTHER PUBLICATIONS

Usman, "Comprehensive Dictionary of Chemical Engineering", 2015, 465-466.

*Primary Examiner* — Erick Solis
*Assistant Examiner* — Anthony L Bacon
(74) *Attorney, Agent, or Firm* — Medley, Behrens & Lewis, LLC.

(57) ABSTRACT

A system and method for fast control of the timing of combustion in an internal combustion engine, comprising actuating a fast-acting fuel-additive supply valve to meter a variable amount of fuel additive into a fuel stream, thereby forming an additive-enhanced fuel with an additive concentration that can be dynamically adjusted as fast as each engine cycle; injecting the additive-enhanced fuel directly or indirectly into a combustion chamber or into an intake port; and combusting the additive-enhanced fuel.

20 Claims, 8 Drawing Sheets

(56) References Cited

U.S. PATENT DOCUMENTS

| | | | | |
|---|---|---|---|---|
| 4,499,878 | A | 2/1985 | Igashira et al. | |
| 4,557,221 | A * | 12/1985 | Kamel | F02B 51/00 123/1 A |
| 5,758,496 | A * | 6/1998 | Rao | B01D 53/944 422/169 |
| 6,067,964 | A | 5/2000 | Ruoff et al. | |
| 6,213,086 | B1 | 4/2001 | Chmela et al. | |
| 6,659,088 | B2 | 12/2003 | Church et al. | |
| 7,389,753 | B1 | 6/2008 | Lee | |
| 7,552,585 | B2 | 6/2009 | Rigaudeau et al. | |
| 7,704,289 | B2 | 4/2010 | Arters et al. | |
| 7,937,206 | B2 | 5/2011 | Forti et al. | |
| 9,663,739 | B2 * | 5/2017 | Cannella | C10L 10/12 |
| 2001/0017127 | A1 * | 8/2001 | Flynn | F02B 1/12 123/435 |
| 2002/0167103 | A1 | 11/2002 | Ickinger | |
| 2007/0101969 | A1 * | 5/2007 | Lay | F02M 25/00 123/304 |
| 2007/0209607 | A1 | 9/2007 | Williams et al. | |
| 2008/0037908 | A1 | 2/2008 | Kunstmann et al. | |
| 2009/0165759 | A1 | 7/2009 | Sengupta et al. | |
| 2009/0216423 | A1 | 8/2009 | Forti et al. | |
| 2010/0063712 | A1 | 3/2010 | Bromberg et al. | |
| 2011/0048353 | A1 * | 3/2011 | Livshits | F02B 43/10 123/1 A |
| 2011/0290207 | A1 * | 12/2011 | Kaufman | F02B 7/04 123/1 A |
| 2013/0125867 | A1 * | 5/2013 | Krug | F02M 37/0088 123/575 |
| 2013/0306028 | A1 | 11/2013 | Monsallier et al. | |
| 2014/0116543 | A1 * | 5/2014 | Kojima | F02M 37/0082 137/561 R |
| 2014/0238349 | A1 | 8/2014 | Harle et al. | |
| 2015/0315990 | A1 * | 11/2015 | Brue | F02M 35/10209 701/103 |

* cited by examiner

ADDITIVE-MIXING FUEL-INJECTION SYSTEM FOR INTERNAL COMBUSTION ENGINES

CROSS-REFERENCE TO RELATED APPLICATION

This application claims priority to U.S. Provisional 62/053,468, filed on Sep. 22, 2014, which is hereby incorporated by reference in its entirety.

STATEMENT OF GOVERNMENTAL INTEREST

This invention was developed under Contract DE-AC04-94AL85000 between Sandia Corporation and the U.S. Department of Energy. The U.S. Government has certain rights in this invention.

FIELD

This disclosure relates to fuel and fuel additives. More specifically, this disclosure relates to fuel and fuel additives for internal combustion engines.

BACKGROUND

The development of commercially viable engines having very high thermal efficiencies (TE) is a global challenge, as the demand for ground transportation increases while being constrained by limited petroleum supplies and the need to reduce $CO_2$ emissions. Increasing the efficiency of engines that operate on gasoline (or similar alternative fuels) offers high potential for improvement since current gasoline spark-ignition (SI) engines are considerably less fuel efficient than diesel engines. Low-temperature gasoline combustion (LTGC), sometimes called homogeneous charge compression ignition (HCCI) or other names in the literature, is a relatively new combustion process that has been shown to have promise for automotive- and truck-sized engines. These LTGC engines can be highly fuel efficient, and the load-range of these engines has been improved, with operation from idle to high loads similar to those of turbocharged diesel engines having been demonstrated. However, controlling the autoignition process, which directly affects combustion timing, over the load-speed map remains a significant technological challenge.

SUMMARY

This disclosure relates to a system and method for rapidly adjusting the autoignition reactivity of gasoline to provide fast control of the combustion timing in LTGC engines, which rely on compression ignition of a premixed or partially premixed charge, over the load-speed map and through transients. Very small amounts of diesel-fuel ignition improvers (e.g. ethylhexyl nitrate) can significantly enhance the autoignition reactivity of gasoline. A system and method are provided herein for metering and mixing variable amounts of ignition-improving additive into the fuel, at or near the fuel injector, and, in an embodiment, adjusting the amount dynamically on a cycle-by-cycle basis to provide rapid, robust control over the operating map and through transients. The additive injection system could also be coupled with a closed-loop control system to maintain smooth, stable operation.

A system and method include controlling the timing of combustion in an internal combustion engine, comprising actuating a fast-acting fuel-additive supply valve to meter a fuel additive into a fuel stream, thereby forming an additive-enhanced fuel; injecting the additive-enhanced fuel directly or indirectly into a combustion chamber or into an intake port; and combusting the additive-enhanced fuel.

BRIEF DESCRIPTION OF THE DRAWINGS

FIG. 4A and FIG. 4B are schematic views. FIG. 4C is a partial cross-section perspective view.

FIG. 5A is a schematic view. FIG. 5B and FIG. 5C are partial cross-section perspective views of the same embodiment.

DETAILED DESCRIPTION

Figure 1:
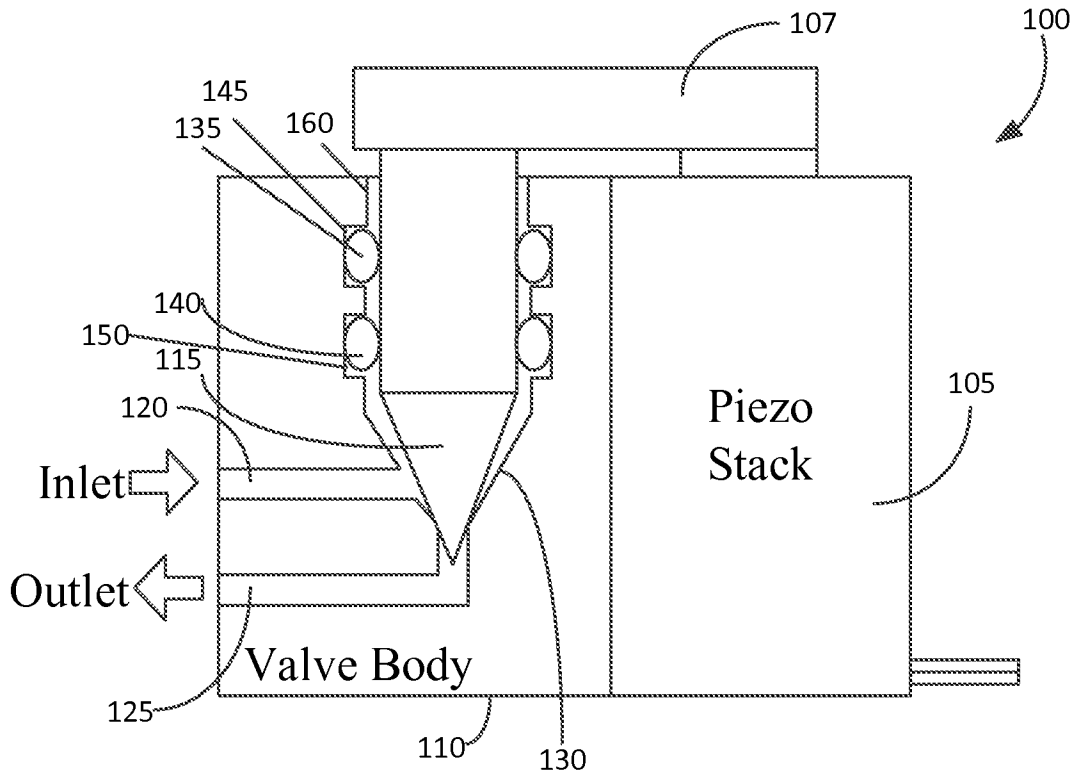
FIG. 1 is a schematic view of an embodiment of the piezoelectric-actuated, fuel-additive supply valve.

Combustion timing in an LTGC engine is controlled by the chemical kinetics of autoignition of the fuel/air/residual-gas mixture as it is compressed by the piston. As load and speed are varied over the operating map, the kinetic rates must be adjusted so that combustion occurs at the proper crank angle. These chemical-kinetic rates are sensitive to many factors including intake temperature, intake pressure, fuel/air equivalence ratio, oxygen concentration, and the autoignition reactivity of the fuel. Currently available techniques are complex, not sufficiently robust, and have difficulty providing sufficiently rapid control for good performance through transients. Moreover, they typically reduce the thermal efficiency potential of LTGC, and limit its load potential.

The additive-mixing fuel-injection system described herein, works on the principle of using small amounts (e.g. tenths of a percent) of a fuel additive to vary the autoignition reactivity of the fuel (typically gasoline, gasoline/ethanol blends, or other gasoline-like (alternative) fuels). Inexpensive diesel-fuel ignition-improvers, such as 2, ethyl hexyl nitrate (EHN) or di-tert butyl peroxide (DTBP), have recently been shown to be effective as additives for enhancing the autoignition of gasoline, using only very low concentrations. In an embodiment, for real-time control of the combustion timing, the amount of additive is adjusted on-demand as the engine traverses the load-speed operating map. Thus, in an embodiment, minute amounts of additive are precisely metered and mixed with the fuel, such as on an injection-by-injection basis, as operating conditions vary. This is a significant challenge given the sub-millisecond timescales, small additive quantities, and pressure waves that result from the fuel-injection process. The system and methods described herein can also allow operation at low-load/idle and cold-start conditions that have been quite challenging for LTGC engines, and it can allow the use of partial fuel stratification (PFS), a technique that allows higher loads and gives further increases in efficiency, over a wider portion of the operating map, as explained in, Dec, J. E., Yang, Y., and Dronniou, N., "Boosted HCCI—Controlling Pressure-Rise Rates for Performance Improvements using Partial Fuel Stratification with Conventional Gasoline," SAE Int. J. Engines, 4(1): 1169-1189, 2011, doi: 10.4271/2011-01-0897.

The systems and methods disclosed herein provide a straightforward, direct, combustion-timing control system, using an ignition-enhancing additive to control LTGC. In contrast, other control systems for LTGC engines are deficient in several respects as detailed below.

The most common technique uses cam-profile switching and cam phasers to retain a variable amount of hot residuals from the previous cycle, and this is often combined with variable fueling during the negative valve overlap using a GDI (gasoline direct injection) injector, and the use of cooled EGR (exhaust gas recirculation). Adjustment of the control systems is complex, not always sufficiently fast, and the load range is limited, so combustion-mode switching from LTGC to conventional SI (spark ignition) at higher loads is typically required. Moreover, efficiency is compromised because the engine is in LTGC mode only part of the time, and the need to operate in SI mode limits the maximum allowable compression ratio (reducing overall efficiency).

A dual-fuel technique, reactivity controlled compression ignition (RCCI) that controls autoignition timing by varying the ratio of a low-reactivity fuel (e.g. gasoline) and a high-reactivity fuel (e.g. diesel) has also been demonstrated. Although this gives good control, two fuels and two fueling systems are required, and the maximum load is limited to about three-fourths that of a diesel engine unless a very high-octane-number fuel (e.g. 85% ethanol in gasoline) is used for the low-reactivity fuel.

A third technique is to inject the gasoline under moderate-to-high pressure using diesel-type direct fuel-injection equipment. This technique is sometimes called partially premixed compression ignition (PPCI or PCI), partially premixed combustion (PPC), or gasoline compression ignition (GCI). The lower reactivity of the gasoline, compared to diesel fuel, gives it time for significant premixing prior to autoignition, and combustion timing is controlled by the fuel-injection process. However, premixing is insufficient under many conditions, leading to emissions of nitric oxides (NOx) and soot that require after-treatment. Furthermore, a gasoline with a very low octane number of about 70 can be required to reach lower loads, which would require a new fuel to be introduced into the market.

In contrast, the system described here requires only a single device for rapid positive control, and it can operate on currently available gasoline. Additive quantities are sufficiently small that a one-gallon container would last about 10,000 miles in a typical mid-sized car, so it would only need to be replenished at service intervals. A fast-acting control valve will provide the required positive control of the additive flow, and it allows a significant pressure differential between the additive supply and the fuel-line, which is required to introduce the additive and mix it on engine-cycle timescales and to minimize the effect of pressure variations in the fuel line.

In an embodiment, a fast-acting fuel-additive supply valve, in particular when combined with a flow-restricting orifice, allows quick and precise metering of an additive to control the timing of combustion and affect other properties in an internal combustion engine. A high-speed, piezoelectric-actuated, fuel-additive supply valve may be used for this purpose, and this example is discussed in detail herein. However, other valves that can be operated at high speed, such as, for example, a solenoid-operated valve, may also be used.

With a piezoelectric-actuated, fuel-additive supply valve, very high-speed actuations are possible due to the ultra-fast piezoelectric actuation of the valve. In an embodiment, the piezo-actuated valve operates in an open-shut mode, with the flow during the open time being controlled by a flow-restricting orifice. The piezo stacks are capable of actuating the valve with sufficient speed and precision, so that with the additive flow rate controlled by a restrictive orifice, the additive can be metered with nano-liter precision. The amount of additive supplied is controlled by varying the length of time that the valve is open. Multiple fuel-additive supply valve opening and closings of a shorter duration (a burst of short pulses) can also be used instead of a single longer opening to control the amount of additive supplied, which has advantages for distributing the additive into the fuel stream. In addition, the piezoelectric-actuated fuel-additive supply valve is capable of operating at 120 to 300 bar injection pressures that are typical of fuel injectors for gasoline direct injection (GDI).

In an embodiment, the piezoelectric-actuated, fuel-additive supply valve 100 the piezo stack 105 actuates a conical needle in a specially designed seat as shown in a simplified schematic view in FIG. 1. This figure shows the piezo stack 105 in a "push" type configuration with the valve body 110 to the side, wherein upon applying voltage to the piezo stack 105 (with sufficient current to accommodate the initial capacitance of the stack) the piezo stack 105 pushes up on a connector 107 that is connected to the valve needle 115. The valve needle 115 is thus pushed up, opening a pathway connecting the inlet 120 to the outlet 125. A conical valve needle 115 is depicted in a frusto-conical chamber 130 of the valve body 110, but other geometries may be used. Seals 135, 140 are shown in recessed chambers 145, 150 of the upper cylindrical portion 160 of the valve body 110. These seals 135, 140 prevent escape of the fuel additive from the top of the valve body 110. With this embodiment a restrictive flow orifice is not required and the amount of additive is metered by controlling both the open-shut timing and the lift of the valve needle.

Figure 2:
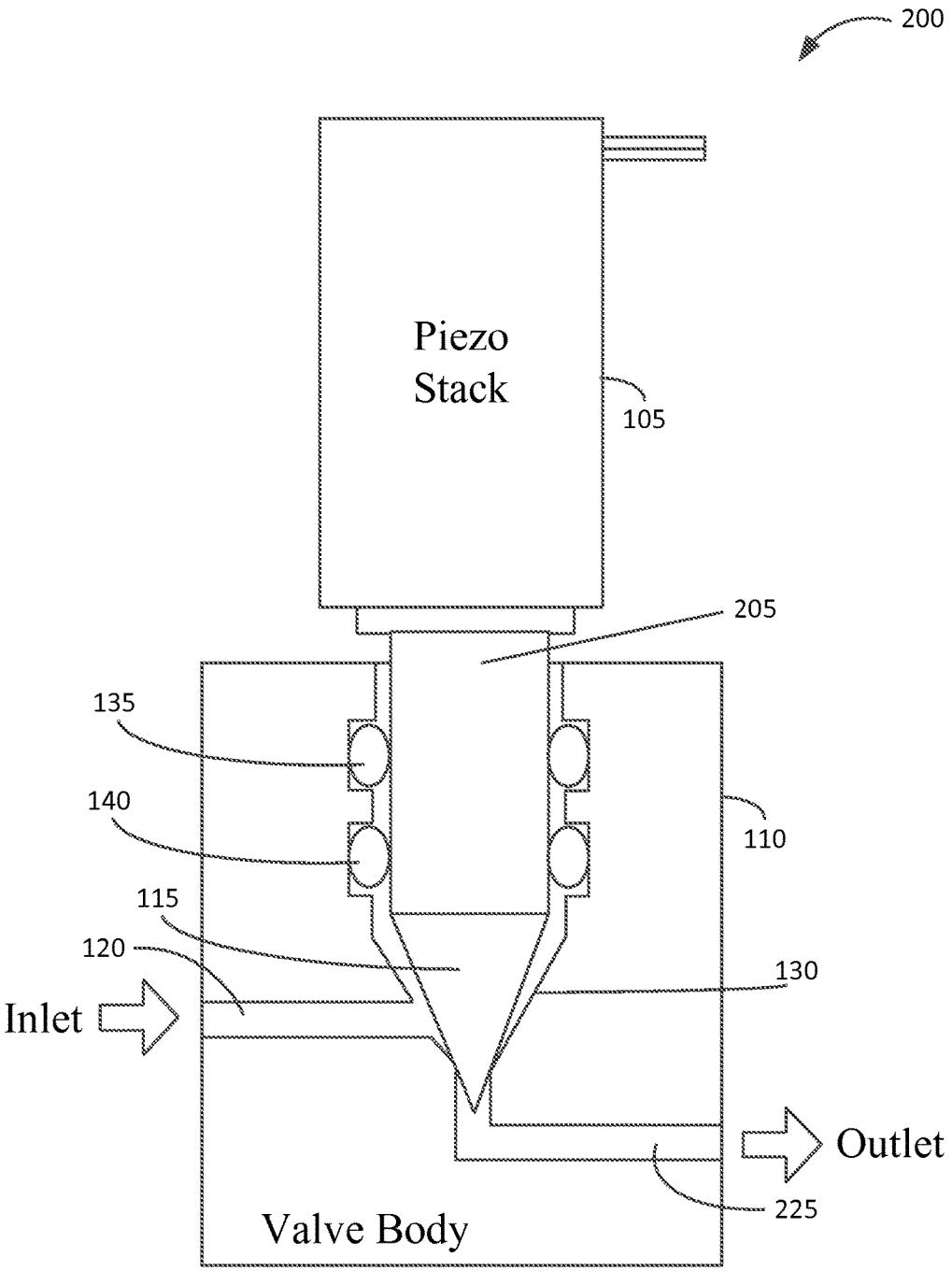
FIG. 2 is a schematic view of another embodiment of the piezoelectric-actuated, fuel-additive supply valve.

In another embodiment of the piezoelectric-actuated, fuel-additive supply valve 200, shown in FIG. 2, the piezo stack 105 is mounted directly on top of the valve body 110, but the piezo stack 105 is hollow so that an actuator rod 205 can extend from the valve needle 115 up through the piezo stack 105. In this embodiment, the piezo stack 105 would still use a pushing action to open the piezoelectric-actuated, fuel-additive supply valve 200, i.e. by pushing the valve needle 115 up. The outlet 225 is also shown in FIG. 2 in a different configuration, extending opposite the inlet 120.

In an embodiment, the fast-acting fuel-additive supply valve could be made very small such as by using MEMS (microelectromechanical system) technology. In an embodiment, the piezoelectric-actuated, fuel-additive supply valve is built into the fuel injector itself, such as by use of MEMS technology or another means of making it sufficiently small. As such, the fast-acting fuel-additive supply valve, such as a piezoelectric-actuated, fuel-additive supply valve, may be coupled to the fuel injector by being housed within the fuel injector. In an embodiment, a flow-restricting orifice and mixing system are also built into the body of the injector.

In an embodiment, the fast-acting fuel-additive supply valve has an opening time or a closing time of about 5 to about 25 microseconds each, such as about 10 to about 15, or about 11 to about 14 microseconds, so that very short additive-supply pulses into the fuel stream can be used. Pulse lengths may range down to about 70 microseconds, such as about 100 microseconds to about 1 second or about 0.2 seconds, or about 150 microseconds to about 500 microseconds. The size of a flow-restricting orifice can be selected to compensate for variations in the minimum pulse length. In an embodiment, based on desired additive concentration in the fuel stream, the pulse duration (i.e. open time of the valve) may vary in the approximate range of 70 to 500 microseconds from pulse to pulse. Also, the number of additive pulses per fuel injection event (engine cycle) is expected to be varied from about 1 for idle to about 20 for high loads, such as 5 to 15 or 10 to 12 (the desired number of pulses can vary depending on fuel mixing strategies and engine-design parameters such as engine size, fuel conduit diameter, etc.).

In an embodiment, multiple pulses within a single engine cycle (fuel injection event) are employed to distribute the additive longitudinally along the fuel stream as the fuel moves past the point where the additive is supplied. This can provide better mixing, particularly at high loads, for which, for example, a slug of fuel up to 34 mm long (for an approximately 2 mm diameter fuel tube and an engine with a displacement of about one-liter/cylinder) moves down the fuel-supply tube and is injected each engine cycle. With multiple additive pulses, a bit of additive can be supplied about every 2 to 3 mm along this 34 mm-long slug, thereby reducing the effort required to mix the additive with the fuel.

Thus, in an embodiment, the piezo valve is configured to supply, for example, a burst of 10 to 20, 100 microsecond pulses of additive, as fast as one pulse every 500 microseconds, for each engine cycle (injection event). For example, a burst would be initiated every engine cycle, which would be about every 40 milliseconds at 3000 rpm (25 bursts per second).

It should be recognized that various engineering tradeoffs can be used (e.g. orifice hole size, additive supply pressure, fuel-supply tube (conduit) diameter, fuel supply pressure, mixing techniques. etc.) to adjust the additive supply-valve timing and open-shut duration numbers given as examples here.

In an embodiment, the inlet and outlet for the fast-acting fuel-additive supply valve are microfluidic conduits that have interior diameters, for example, of 1 micrometers to 1 mm, such as 20 to 50, or 100 to 500 micrometers. In another embodiment, the inlet and outlet are larger, and have diameters, for example, of 1 mm to 1 cm, such as 1.25 mm to 7.5 mm, or 1.5 mm to 5 mm. In yet another embodiment, the diameters of the inlet and outlet may be selected independently from the example size ranges given above. These conduits may be made from a durable, corrosion resistant material such as stainless steel, but other materials could also be used.

The piezoelectric element of the piezo-electric, fuel-additive supply valve is made of a piezo material, such as ceramic or perovskite. The piezoelectric element may be an amplified piezo structure. In an embodiment, the piezo material is structured as a many-layered (perhaps hundreds of layers) stack.

Figure 3:
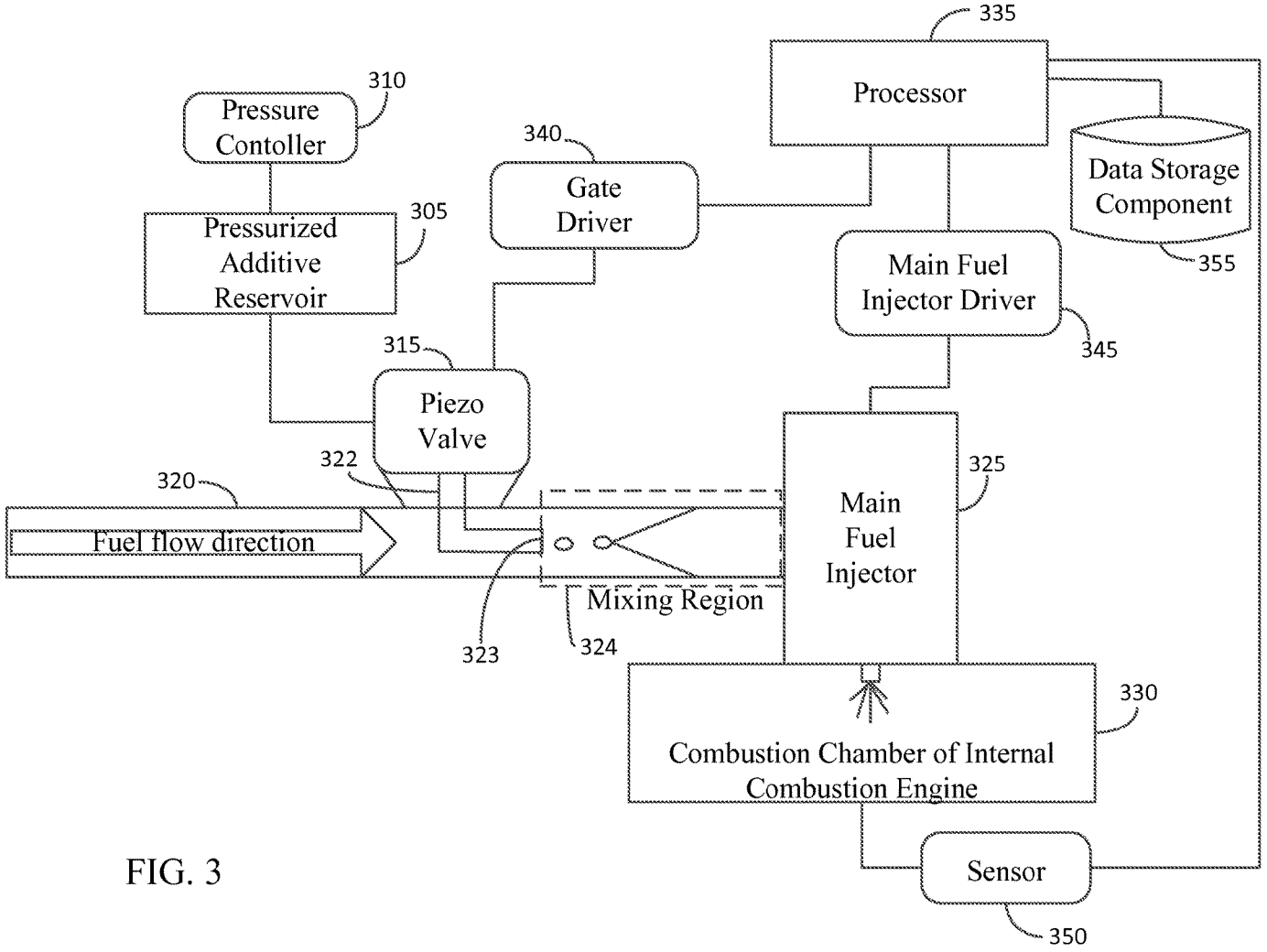
FIG. 3 is a schematic of an embodiment of the additive-mixing fuel-injection system configured with a fast-acting, piezoelectric-actuated, fuel-additive supply valve to control the combustion timing of the engine.

FIG. 3 shows an embodiment of a system 300 including the combustion chamber 330 of an internal combustion engine that has a fuel injection system incorporating the piezoelectric-actuated, fuel-additive supply valve that can be used with the method described herein for controlling the combustion timing of the engine.

The fuel additive is contained in a pressurized additive reservoir 305. The pressure in the additive reservoir 305 is controlled by a pressure controller 310. In an embodiment, the pressure is maintained in the reservoir at pressure that is substantially greater than the pressure of the fuel supplied to the injector, for example, 20 to 100 bar higher, such as 30 to 50 bar higher, or 40 to 80 bar higher. Since the fuel injector may have an injection pressure of, for example, 100 to 300 bar, the pressurized additive reservoir 305 may have a pressure of, for example, 120 to 400 bar. Supplying the additive at this higher pressure allows more robust control of additive metering by the fast-acting piezo valve and flow-restricting orifice (if present). It also aids in dispersing the additive into the fuel line and in mixing the additive with the fuel. The pressurized additive reservoir is coupled to the inlet of the fuel-additive supply valve 315. In this embodiment, the fuel-additive supply valve is a fast acting, piezo-electric-actuated, fuel-additive supply valve 315.

The fuel-additive supply valve 315 is coupled (from the outlet) to the fuel-stream conduit 320. In an embodiment, shown in FIG. 3A, a flow-restricting orifice 365 is coupled to the outlet conduit 322 and restricts the flow of the additive from the fuel-additive supply valve 315 to the fuel-stream conduit 320. The flow-restricting orifice 365 controls the flow rate of additive into the fuel stream when a fast-acting open-shut fuel-additive supply valve 315 is used. In this embodiment, only changes in the duration of the valve-open time are used to adjust the amount of additive supplied to the fuel. In this embodiment, it may be advantageous to use a fuel-additive supply valve with a flatter, less-conical seat than the ones depicted in FIGS. 1 and 2 for more rapid transitions from completely closed to fully open and fully open to completely closed. The flow-restricting orifice 365 also helps ensure that a high pressure differential is kept between the fuel additive (as it is injected into the fuel stream) and the fuel stream. Having a pressure differential in the range noted above (20 to 100 bar) will make the flow rate through the flow-restricting orifice 365 nearly insensitive to the pressure fluctuations (~1-3 bar range) that occur in the fuel line as a result of the fuel-injection process. Thus, in this embodiment, it will be easier to precisely control the flow of the fuel additive. Structurally, the flow-restricting orifice 365 may have a circular or conical opening that is narrower than the outlet conduit 322. Other geometries may also be used to restrict the flow of the additive.

In the embodiment shown in FIG. 3, the flow-restricting orifice 365 is not used, and the additive flow rate is controlled by controlling the opening clearance of the piezo-electric additive-supply valve in addition to controlling its open/shut timing. However, this embodiment requires a more complex driver for the piezoelectric valve, because the opening clearance must be precisely controlled as well as the open/shut timing. Alternatively, for the embodiment shown FIG. 3, the additive-supply valve could be designed so that it's maximum opening clearance gives a flow rate similar to that of the flow-restricting orifice 365 discussed above, or the maximum valve opening could be restricted (such as by a mechanical device that limits the valve motion) to give a flow rate similar to that of the flow-restricting orifice. With designs such as these, only relatively simple open-shut timing control of the additive-supply valve would be required, similar to having a flow-restricting orifice. Although there may be advantages to this type of design, in that a flow-restricting orifice is not required, it could be more difficult to make adjustments to the additive flow rate during the valve-open time. For all these cases, the opening clearance (either a dynamically controlled or fixed) of the additive-supply valve acts to maintain the pressure differential between the additive supply and the fuel stream, thus giving the benefits noted above with respect to the flow-restricting orifice.

In an embodiment, the outlet conduit 322 of the fuel-additive supply valve 315, or the outlet 367 of the flow-restricting orifice 365 (if present), is coupled in a location that is very near the fuel injector 325. The closer that the outlet conduit tip 323, is positioned to the fuel injector 325, the more rapidly the additive or changes in the amount of additive have an effect on the combustion timing. That is, the closer the outlet conduit tip 323 is to the fuel injector 325, the lower the lag time is between the fuel-additive supply valve 315 opening and the effect on the engine combustion timing, for a given fuel-stream conduit 320 diameter. The additive may be metered into the fuel stream ten inches or less from a fuel injector that is coupled to the engine. For example, the distance from the outlet conduit tip 323 to the fuel injector 325 may be from 10 inches to 0.1 inch, such as, 6 inches to 1 inch, or 2 inches to 0.5 inches. Since it is actually the volume of fuel in the fuel-stream conduit 320 between the outlet conduit tip 323 and the fuel injector 325 that determines the time lag, the diameter of the fuel-stream conduit 320 also affects the response time of this combustion-timing control system. Accordingly, in some embodiments it may be advantageous to use smaller diameters for the fuel-stream conduit 320 with longer lengths to minimize lag time when longer lengths are required, keeping in mind that smaller diameters can increase the pressure drop in the fuel-stream conduit 320 (restrict the flow of fuel to the fuel injector 325). The distance from the outlet conduit tip 323 to the fuel injector 325 defines a region in the fuel-stream conduit 320 that may be referred to as the mixing region 324.

While eliminating the lag of the effect of introducing the fuel additive is desirable, dispersion of the fuel additive into the fuel stream is also desirable. The design of the system should take into account a proper balance of these two competing functions. In some embodiments, to ensure both good dispersion and good control through rapid transients, additive mixing occurs just upstream of the fuel injector 325, depending on factors such as the pressure difference of the fuel stream and additive supply, the type of additive and fuel, and the geometry of the outlet conduit 322 or outlet 367 of the flow restricting orifice and outlet conduit tip 323. Absent any other dispersing mechanisms, or with some static mixing devices, a somewhat greater length of fuel-stream conduit 320 may be employed to disperse the additive effectively, such as, for example, 12 inches to 6 inches, 10 inches to 7 inches, or 9 inches to 8 inches. As mentioned above, the diameter of the fuel-stream conduit may also be adjusted in conjunction with the length of the mixing region 324.

Other mechanisms may be employed to obtain sufficient dispersion of the fuel additive with the fuel in the fuel stream so that autoignition is consistent from cycle to cycle for a given amount of fuel additive supplied. In an embodiment, a system to mix the additive with the fuel in the fuel-stream conduit 320 is also employed, which may allow for a shorter length from the outlet conduit tip 323 to the fuel injector 325. Particular mechanisms to accomplish this dispersion include those shown in FIG. 4A delivery through multiple capillary outlet tips 423; 4B incorporating an ultrasonic transducer mixer 460; and 4C incorporation of a static mixer in the fuel-stream conduit 320 that could include, for example, shaped baffles 470, or other flow obstacles or channels to enhance mixing.

Figure 5A:
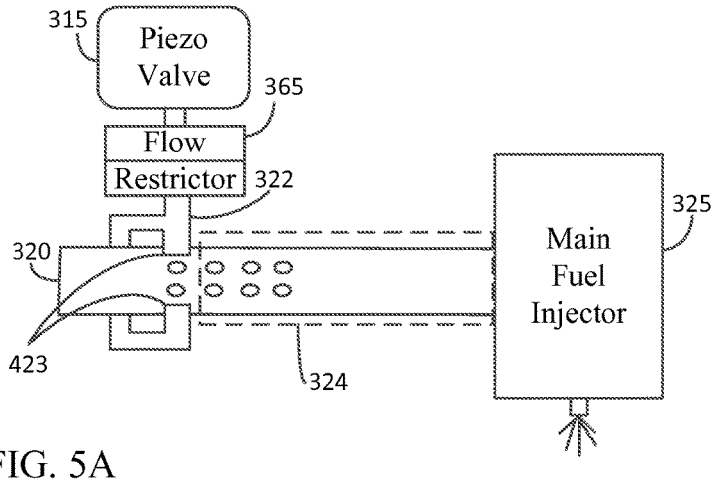
FIGS. 5A, 5B, and 5C shows additional examples of apparatuses to facilitate dispersion of a fuel additive in a fuel-stream conduit.
Figure 5B:
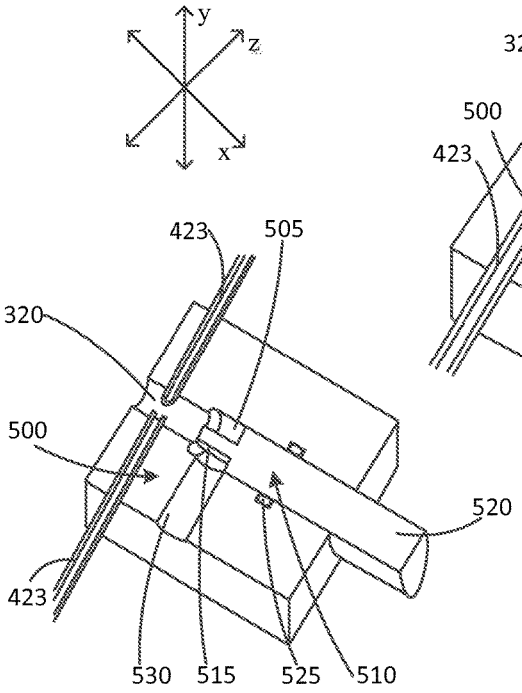
Figure 5C:
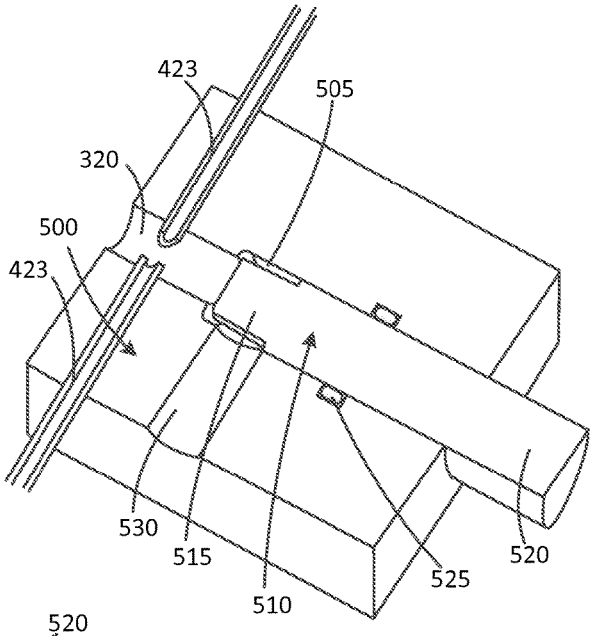

FIGS. 5A, 5B, and 5C shows additional mechanisms for encouraging mixing of the fuel additive with the fuel in the fuel stream. FIG. 5A shows a variation of the multiple capillary outlet tips 423, wherein multiple capillary outlet tips 423 are disposed about the radial circumference of the fuel-stream conduit 320. Optionally, one to eight capillary outlet tips 423, such as two, four, or six capillary outlet tips 423 may be disposed around the radial surface of the fuel-stream conduit 320. These capillary outlet tips 423 may, for example, be placed equidistant from each other as shown for the two capillary outlet tips 423 in FIG. 5A, or they may be placed at unequal distances to promote mixing. The capillary outlet tips 423 may be set flush with the wall of the fuel-stream conduit 320, or they may extend into the fuel conduit a moderate distance, such as 1% to 50% of the fuel-conduit radius as depicted in FIGS. 5A, 5B and 5C, or they may extend in clear to the centerline, such as 51% to 100% of the fuel-conduit radius, to improve mixing.

In an embodiment, an active mixing system may be used. FIGS. 5B and 5C show two orthogonal cross-sectional views of the paddle head of a fuel-stream paddle mixer 500. The paddle mixer 500 is coupled to the fuel-stream conduit 320, and, in this embodiment, is coupled to two multiple capillary outlet tips 423 that introduce the additive radially from opposite sides of the fuel-stream conduit 320, upstream of the paddle component 510. The fuel-stream conduit 320 is coupled to a cylindrical paddle compartment 505, in which a paddle component 510 resides. The paddle component 510 comprises a cylindrical shaft and a paddle head 515 that has a blade-like rectangular cross-section. The width of the paddle head 515 extends from the center of the paddle component 510 to about 80 to 90% of the outer radius of the paddle component 510 (in both the positive and negative z-axis directions for the view in FIG. 5C). This "clearanced" embodiment shown in 5C promotes mixing and reduces the pressure drop. However, in various embodiments, the width of the paddle head 515 may extend from 50% to 100% of the distance to the outer radius of the paddle component 510, such as 70% to 95%, or 90% to 97%, or 85 to 90%. The paddle head 515 has a thickness that is typically much less than the full thickness of the paddle component 510, as depicted in the orthogonal view in FIG. 5B (as the thickness in the z-axis direction). In this direction, the thickness of the paddle head is about 20% of the diameter of the paddle component 510, but it could vary from 5% to 90% of the diameter, such as 10% to 65%, 30 to 50%, or 45% to 60% the diameter. The paddle head 515 is coupled to the paddle shaft 520 that contacts a seal 525, such as an o-ring seal, and extends out of the paddle compartment 505. The paddle component 510 is driven by a motor, belt, or other mechanism (not shown) that imparts a rotational force to the paddle component 510. FIG. 5C shows the paddle component 510 rotated 90 degrees from the position in FIG. 5B. The paddle mixer 500 operates to mix the fuel and the additive, and it includes an outlet 530 downstream from the mixing region 324 that is coupled to the main fuel injector (not shown in FIGS. 5A, 5B, 5C). It will be readily understood by those skilled in the art that many other shapes could be used for the paddle head instead of the single flat blade depicted here.

For example, the head could be comprised of two blades that cross at 90 degrees, multiple blades, or various other polygonal or curved shapes.

Figure 4A:
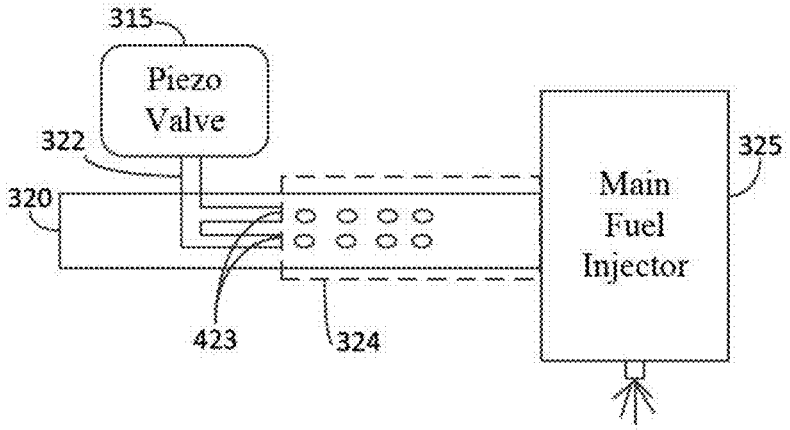
FIGS. 4A, 4B, and 4C shows examples of apparatuses to facilitate dispersion of a fuel additive in a fuel-stream conduit.
Figure 4B:
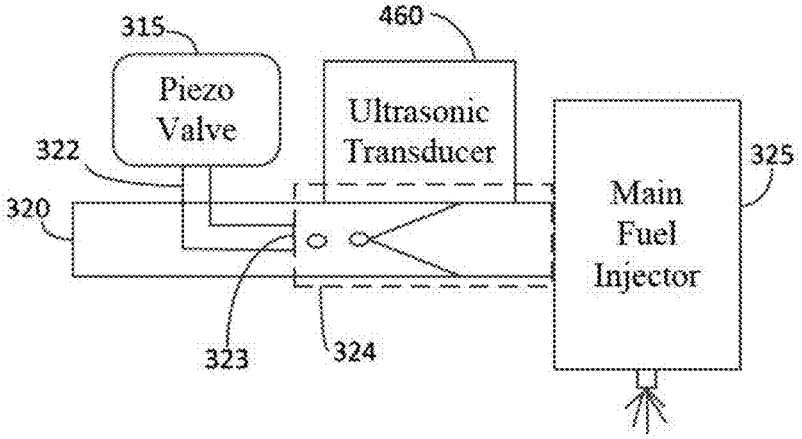
Figure 4C:
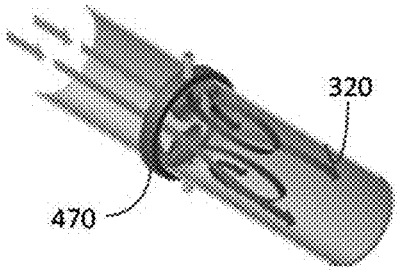

Static mixing systems include those shown in FIGS. 4A and 4C, and FIG. 5A. Active mixing systems include those in FIG. 4B and FIGS. 5B and 5C. Combinations of the mechanisms shown in FIGS. 4 and 5, or other mechanisms not shown here could also be used.

Figure 3A:
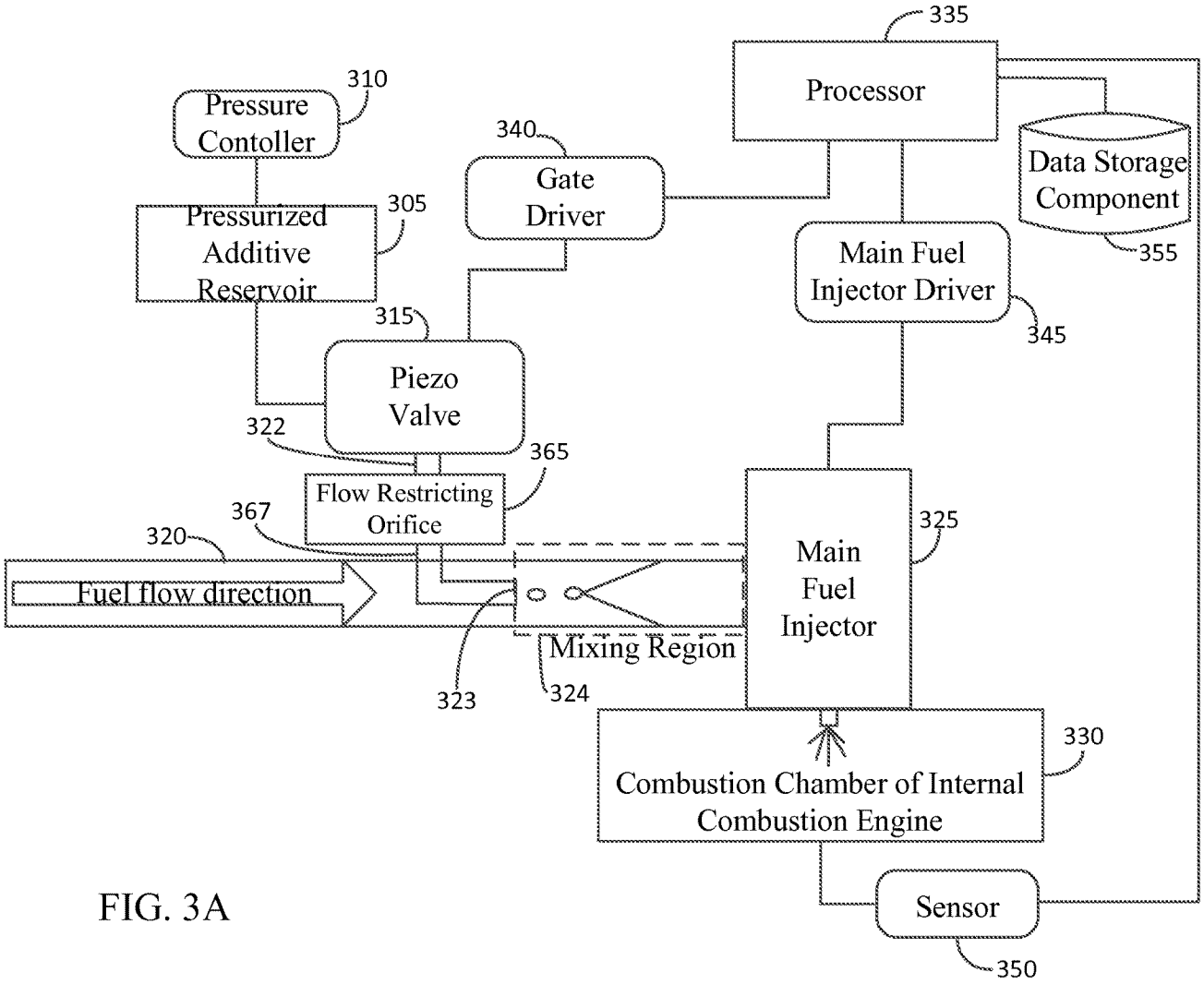
FIG. 3A is a schematic of an embodiment of the additive-mixing fuel-injection system configured with a fast-acting, piezoelectric-actuated, fuel-additive supply valve combined with a flow-restricting orifice to control the combustion timing of the engine.

While injection into the engine intake manifold or intake port is possible with the system and method described herein, direct fuel injection (e.g. GDI) into the combustion chamber 330 is preferable in at least some embodiments, to minimize delays between changes in amount of additive supplied to the fuel stream and changes in the mixture being burned. Also, because direct fuel injection has advantages independent of this control system. Such an embodiment is represented in FIGS. 3 and 3A, where the additive is supplied just upstream of a fuel injector 325 that is coupled directly to the combustion chamber 330 of the engine. In another embodiment, the fuel-additive supply valve 315 and flow-restricting orifice 365 (if present) are incorporated into the body of the fuel injector 325 for rapid control and compact packaging.

In an embodiment, an additional aspect of having an outlet conduit 322, an outlet of the flow-restricting orifice 367, an outlet conduit tip 323, or tips 423 with capillary-sized small diameters to transfer the fuel additive from the fuel-additive supply valve 315 or the flow-restricting orifice 365 to the fuel-stream conduit 320 is that they can significantly mitigate the effect of fuel-line pressure fluctuations that occur as a result of the fuel injection process, before these fluctuations reach the fuel-additive supply valve 315 or the orifice 365.

The timings of the fuel-additive supply valve 315 and the fuel injector 325 are controlled by a processor 335, which in a motor vehicle, may be the engine control unit (ECU). It could also be a separate processor that is dedicated to operating the fuel-additive supply valve and is in communication with the ECU, with the fuel injector being controlled by either the ECU or this separate processor. In the system shown in FIGS. 3 and 3A, the processor 335 executes instructions to synchronize the addition of the fuel additive to the fuel stream and the fuel injection into the combustion chamber 330. The processor 335 sends a control signal to a gate driver 340, such as a mosFET piezo driver, that rapidly energizes the piezoelectric element to operate the fuel-additive supply valve 315.

The processor 335 is also in communication with the ECU or other processor that controls the timing of the actuation of the fuel injector 325 (or the processor 335 may be the ECU or the processor that also controls the actuation of the main fuel injector). Thus, the timing of the fuel-additive addition (via the fuel-additive supply valve 315) into the fuel stream can be synchronized with the main fuel-injection process. This control is used to ensure that an additive-introduction pulse or burst of additive-introduction pulses occurs for each main fuel-injection event so that no fuel flows into the main injector without having been appropriately additized, and that no additive is introduced into fuel that has already been additized. Additionally, in an embodiment, the synchronization allows the additive to be introduced into the fuel stream as the fuel flows down the fuel-stream conduit 320 to the fuel injector 325 during the fuel-injection process, which could help distribute the additive throughout the fuel to be injected. For example, depending on the engine load, fuel will flow a distance of perhaps 2 mm (low load) to 32 mm (high load) down the fuel-stream conduit 320 toward the fuel injector 325 during the duration of the main fuel-injection event (e.g., 0.5-8 ms) (exact distances and durations will depend on the engine size, the fuel-conduit diameter, fuel-injector design, etc.). With synchronization, the additive could be supplied to the fuel as it moves past the location of the outlet conduit tip 323 or tips 423. In this embodiment, the additive could be supplied in a series (or burst) of one to twenty or more short pulses as the fuel flows by, depending on the engine load, and therefore, the distance that the fuel moves down the conduit during an injection event. Using short pulses allows the additive to have a higher momentum to assist in mixing with the fuel. In another embodiment, the additive could be introduced with a continuous flow during the main fuel-injection event, but at a lower flow rate (rather than with a rapid flow during a short pulse or series of pulses). In another embodiment, the additive could be introduced into the fuel in between the main fuel-injection events when the fuel is stationary in the fuel conduit, by supplying the additive through a series of capillary tubes distributed longitudinally along the fuel conduit, or by supplying it at a single fuel-streamwise location (as currently shown) and subsequently applying a separate mixing process. This latter type of embodiment could allow the use of a slower solenoid-type valve for the fuel-additive supply valve 315, but with increased complexity to obtain adequate mixing.

The processor 335 is thus configured to control the timing of combustion in the combustion chamber 330 of the internal combustion engine by adjusting the fuel-additive supply valve 315 to control the amount of fuel additive supplied to the fuel stream, which modifies the autoignition reactivity of the fuel-additive mixture that enters the combustion chamber 330. The timing of combustion in the internal combustion engine may be controlled by controlling an amount of the fuel additive supplied to the fuel stream by varying an open-shut timing of the fuel-additive supply valve 315, by varying an opening clearance of the fuel-additive supply valve 315, or both. Alternatively, the timing of combustion in the internal combustion engine may be controlled by controlling an amount of the fuel additive supplied to the fuel stream by varying an open-shut timing of a fuel-additive supply valve 315 (that opens to a clearance that is sufficiently large so it does not restrict the flow itself) combined with the use of a flow-restricting orifice 365, or an additive-supply valve 315 with a limited maximum valve-open clearance that acts like an orifice to restrict the flow. While open-shut operation to a constant open position is more typical, other embodiments may vary the magnitude of the opening from completely shut, to completely open to a clearance sufficiently large that it does not restrict the flow, such as, for example, from 1% to 95% open, or 25% to 75% open. In an embodiment, the fast-acting fuel-additive supply valve is actuated in a series of one or more pulses each engine cycle to meter the desired amount of additive into the fuel.

In an embodiment, the processor 335 executes instructions to control the amount of additive introduced into the fuel stream by the fuel-additive supply valve 315, using the methods discussed in the previous paragraph, based on sensing the combustion timing of the internal combustion engine as described below.

The processor 335 is also in communication with a sensor 350 that can be used to determine the combustion timing of the engine. In an embodiment, the sensor is a pressure transducer mounted so that it measures the combustion-chamber pressure; however, other sensors such as ionization detectors could be used. The information from the sensor is relayed to the processor 335 where it is analyzed to determine the combustion timing, which is typically taken as the 50% burn point. Based on the difference between the measured and the desired combustion timing, the sensing of a knock or near-knock condition, or the sensing of a misfire or near misfire condition, the processor determines, as described below, a desired open-shut timing, opening clearance, or both (or a desired adjustment to the current open-shut timing, opening clearance, or both) of the fuel-additive supply valve 315. The system, thereby adjusts the combustion timing of the engine to the desired or more optimal value by changing the additive concentration in the fuel being burned.

For multi-cylinder engines, a separate fuel-additive supply valve would typically be required for each cylinder to adjust the additive concentration in the fuel supplied to each fuel injector. Similarly, a sensor (e.g. a pressure transducer) would typically be mounted in each cylinder with the information from each sensor being used by the processor 335 to adjust the amount of additive supplied to the fuel stream for the fuel injector 325 for that cylinder. In some embodiments, it may be possible to only use a sensor on one or less than all of the cylinders, such as if combustion timing is very consistent between cylinders. Also, in some embodiments, a single additive-supply valve might be used to supply additive to the fuel being used for two or more cylinders. This would have the advantage of lower cost, but would not provide independent combustion timing control for the two or more cylinders supplied by the additive-supply valve, and it could result in longer distances between the point of additive introduction and the fuel injectors increasing the time lag for the combustion timing to respond to changes in the amount of additive supplied. In addition, it would limit the ability to synchronize the additive introduction with the fuel-injection event. Thus, in an embodiment one to four additive supply valves and/or sensors could be used on a four cylinder engine, and one to six additive supply valves and/or sensors could be used on a six cylinder engine, and so on for engines with more cylinders.

In embodiments, the system of FIG. 3 or FIG. 3A is calibrated over a wide range of operating conditions and the information on adjusting pulse timing and/or valve opening clearance is stored in a data storage component 355 that is in communication with the processor 335. A vehicle's engine-control unit may comprise both the processor 335 and data storage component 355. In this embodiment, the processor 335 then executes instructions to automatically adjust the fuel-additive supply valve 315 and/or fuel injector 325 based on the calibration data.

In an embodiment, the combustion timing is actively monitored by the processor 335 through information received from the sensor 350, and the fuel-additive supply valve 315 is dynamically controlled by the processor 335 to compensate for changes in the combustion timing over the engine operating map. In an embodiment implementing this feature, the amount of the additive supplied to the fuel stream can be adjusted and fine-tuned for good performance at each engine (or vehicle) operating condition using a closed-loop feedback control system, as discussed in greater detail below. In such a system, the processor 335 receives a signal from the sensor 350, analyzes it to determine the combustion timing, determines if the timing is correct, based on, for example a predetermined value or range, or being too close to knock or misfire limits. If the timing is not correct, the processor determines the changes required and signals the gate driver 340 to adjust the amount of additive supplied until analysis of the signal from the sensor 350 shows the correct timing. Multiple iterations may be required to fine-tune the combustion timing, but with modern processors, the sensor feedback and additive-supply valve adjustment can be accomplished on a cycle-by-cycle basis, i.e. several iterations per second for typical conditions. Instructions for the closed loop feedback control are executed by the processor 335 and stored in a data storage component 355.

For example, in an embodiment, with the processor 335 dynamically adjusting the amount of fuel additive metered into the fuel stream, the combustion timing of an engine can be dynamically adjusted as the engine traverses an operating map, so that at least 98% of the time, (e.g., judged by the total running time) the combustion timing of the engine is maintained within three crank-angle degrees of either a predetermined value or a value based on a combustion timing calculated to avoid the onset of knock or misfire, as determined by an analysis of a signal that indicates combustion timing, for each operating condition on the operating map. The combustion timing may be maintained for example, within 0.5 to 2.5, or 1 to 2 crank angle degrees. If the engine is in steady operation or fairly slow transients, the timing should be within 3 crank angle degrees at all times, and typically less, for example, within 0.5 degrees for near steady conditions. However, in rapid transient conditions the timing could get out of bounds for a few engine cycles, but the dynamically adjusting system would quickly bring it back in bounds (i.e. within a few engine cycles, maybe even one or two engine cycles).

Figure 6:
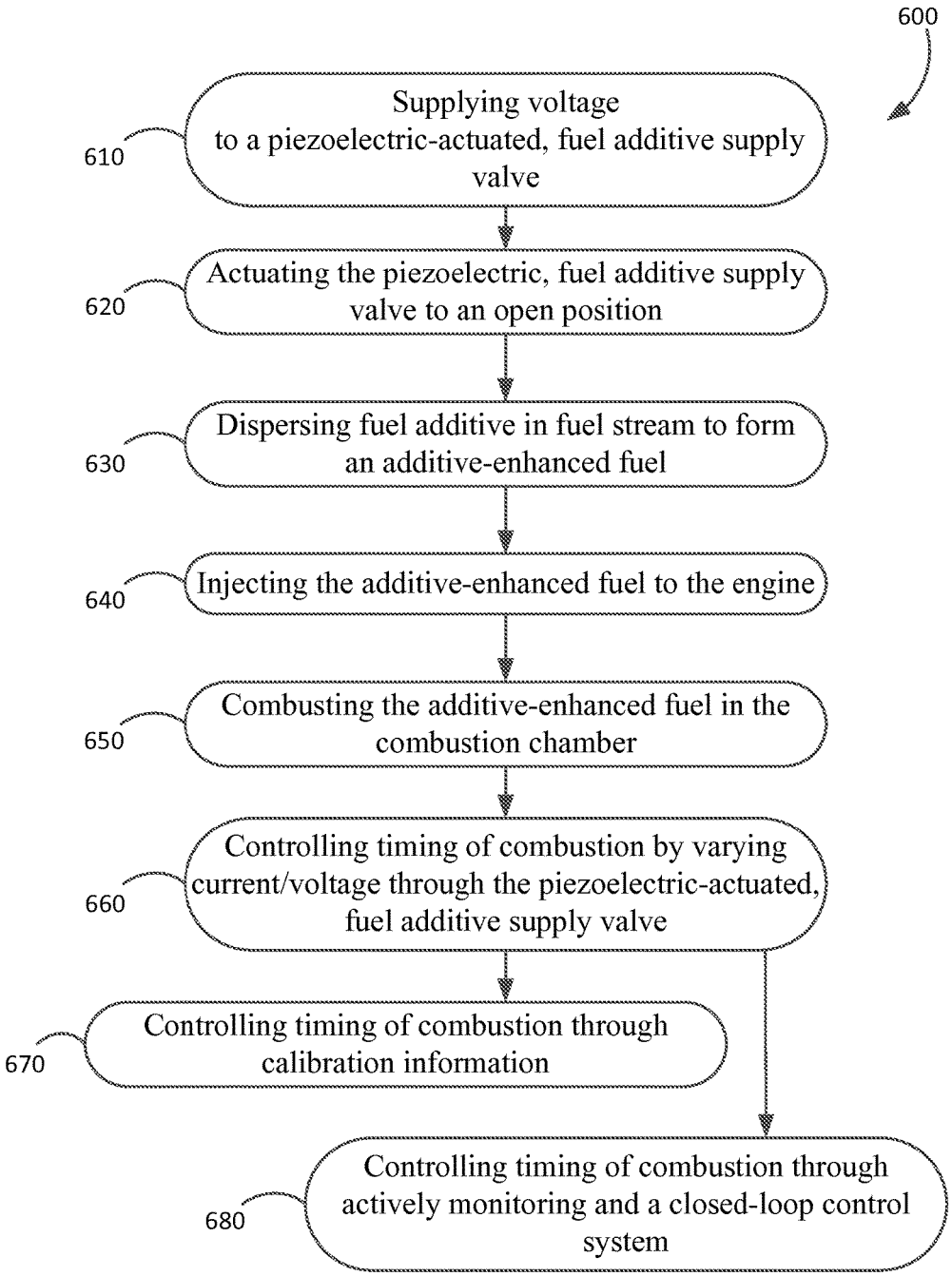
FIG. 6 is a flow chart showing an exemplary method for controlling the timing of combustion in an internal combustion engine.

FIG. 6 shows a flow chart for an exemplary method 600 for rapidly and controllably providing a fuel additive to a fuel stream, for controlling the timing of combustion in an internal combustion engine. At 610, a control signal (sent e.g. from a processor) to a piezo-valve driver causes it to supply an appropriate voltage to a piezoelectric-actuated, fuel-additive supply valve to meter addition of a fuel additive to a fuel stream.

At 620, the piezoelectric-actuated, fuel-additive supply valve is actuated to an open position. This open position may be fully open or less than fully open as described above. In an embodiment, the voltage is pulsed to meter the amount of fuel additive using a designated valve-opening clearance, which can be the fully opened position, and the number of pulses and/or the duration of the pulses can be varied to adjust the volume of additive metered into the fuel stream as discussed above. In another embodiment, the magnitude of the voltage is modified to meter the amount of fuel additive by changing the opening clearance to the outlet of the piezoelectric-actuated, fuel-additive supply valve. Various combinations of valve open-shut times, pulses and clearance adjustments can also be used.

At 630, the fuel additive flows through the outlet conduit tip or tips and is dispersed into the fuel stream to form an additive-enhanced fuel. The dispersion may be facilitated through the higher pressure of the injected fuel additive compared to the fuel stream pressure. Aids to dispersion may also be employed, such as providing a longer mixing zone, a small capillary size outlet tip, or additional measures, such as those discussed above and presented in FIGS. 4 and 5.

At 640 the additive-enhanced fuel is injected through a fuel injector to the engine. The additive-enhanced fuel may be injected directly into the combustion chamber (e.g. a cylinder) using a GDI fuel-injector system or into the intake port using a port fuel injection (PFI) system, A diesel-type direct-injection fueling system may also be used or a direct-injection system with pressure between those typical of GDI and diesel injectors. The additive-enhanced fuel may also be delivered into the intake manifold using a throttle-body type fuel injector or a carburetor.

At 650 the additive-enhanced fuel is combusted in the combustion chamber. This may be performed by increasing pressure and/or temperature in the chamber until the autoignition point of the additive-enhanced fuel is reached. In embodiments, the combustion in the combustion chamber is an LTGC type, HCCI type, stratified combustion (GCI, PPCI, PCI, PPC), spark-assisted LTGC or HCCI, or diesel-type combustion. It could also be spark-ignition combustion, for which an autoignition-suppressing additive is used to prevent knock at key operating points.

At 660 the timing of the combustion is controlled by varying the control signal to the piezo-driver to change the voltage supplied to the piezoelectric-actuated, fuel-additive supply valve, thus controlling the amount of fuel additive supplied to a fuel stream. As explained above, the processor controls the timing and duration of the additive-supply valve through a piezoelectric-valve gate driver. The processor (which may be the ECU) also controls, or is in communication with the ECU or processor that controls, the timing and duration of the fuel-injection process, such as through a fuel injector driver.

At 670, as discussed above, the timing of the combustion control may be controlled by a processor executing instructions based on calibration information stored in memory. Based on this, the processor controls the piezoelectric-actuated, fuel-additive supply valve. For example, the calibration information may associate certain engine parameters, such as load, speed, atmospheric pressure, turbocharger or supercharger boost pressure, intake temperature, engine temperature, with a timing pattern stored in memory for the piezoelectric-actuated, fuel-additive supply valve and/or fuel injector.

Alternatively, at 680, as expressed above, the timing is controlled through actively monitoring the combustion timing, such as by analyzing the signal from a pressure transducer in the combustion chamber and utilizing a closed-loop control system to dynamically adjust the timing from cycle-to-cycle, or as needed. In an embodiment, the amount of additive metered into the fuel stream by the fast-acting fuel-additive supply valve is adjusted as frequently as each step of injecting the additive enhanced fuel (which may be each engine cycle or each fuel-injection event if multiple fuel-injections are used within an engine cycle) to maintain the desired combustion timing. A combination of calibration information 670 and closed-loop control 680 may also be used. For example, for large, rapid changes in operating conditions, the calibration information could be used to quickly change the additive-supply to get it close to the correct value, followed by closed-loop control to fine tune the combustion timing for more-optimal performance.

Figure 7:
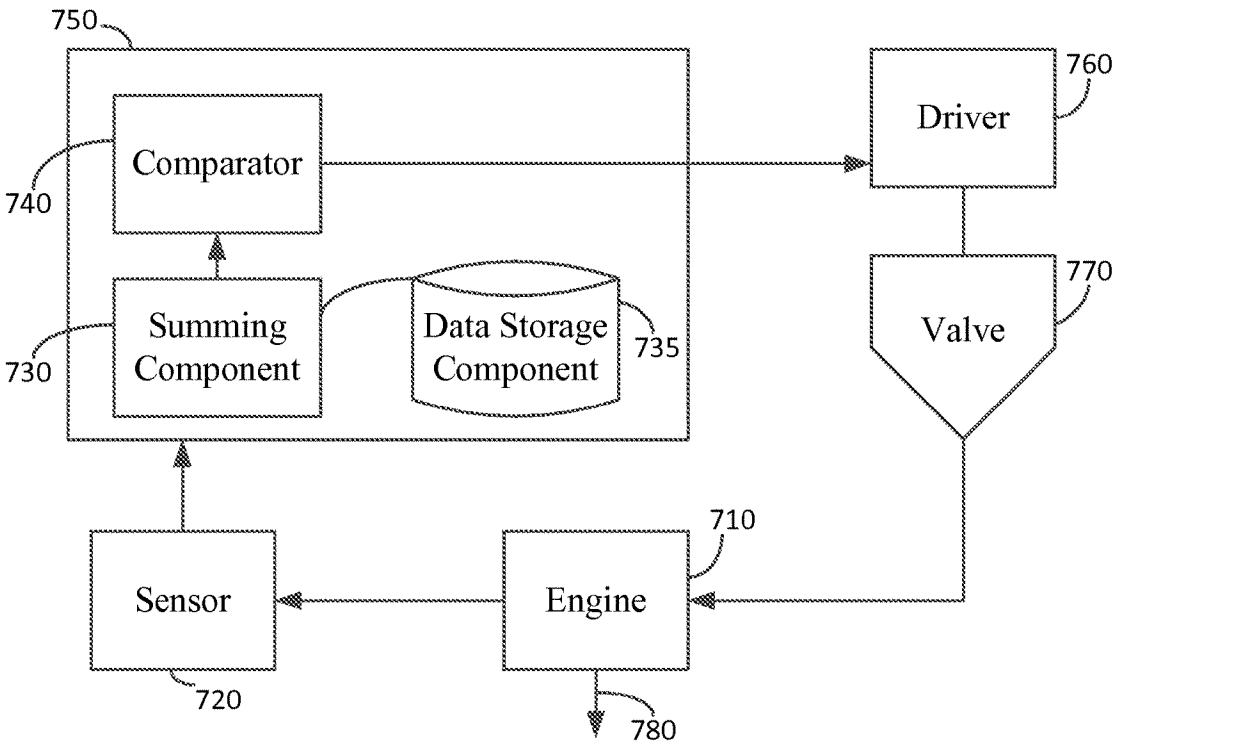
FIG. 7 is a schematic showing an example closed-loop control system for use with the fuel additive injection system.

FIG. 7 is a schematic showing an embodiment of a closed loop control system 700 for use according to the teachings presented herein. During operation of the engine 710, the combustion process produces a rapid rise in the pressure in the combustion chamber. A sensor 720, which may be a pressure transducer, is in communication with the combustion chamber and provides a signal that can be analyzed by the processor (which may be the ECU) to determine the combustion timing. This actual combustion timing is compared to a desired or set-point value, which may have been stored in a data storage component 735. The set-point value may be a combustion timing or range of combustion timings that is, for example, a value that is optimized for prevention of both knock and misfire in the combustion chamber, or a combustion timing that is balanced between high power output 780 and the prevention of knock. Rather than using a stored value, the desired set point value for the combustion timing may also be computed by the processor based on the signal from a cylinder-pressure transducer, knock sensor, or other sensor, such as, for example, a combustion timing that produces a cylinder pressure rise rate corresponding to the onset of knock or near misfire, for the operating condition (load, speed point) of interest. Comparison between the actual and set-point values (either stored or computed set points) of the combustion timing may be performed digitally by the processor. This comparison might also be accomplished using separate summing and/or comparator components, but it is anticipated that these functions are more easily accomplished with the digital processor because the combustion timing must be computed from the pressure signal (or signal from another sensor, such as an ionization detector), and there is not a direct analog between the combustion timing and control signals to the driver 760 for the fuel-additive supply valve 770. The processor would then compute the magnitude of the error (if any) and its direction, and based on this, adjust its output signal to a driver 760 for the piezoelectric-actuated fuel-additive supply valve 770 to increase or decrease the amount of fuel additive provided to the fuel stream being supplied to the engine 710. For example, for an ignition-enhancing additive, if the actual combustion timing was advanced from the set-point timing, the amount of additive would be reduced by reducing the duration of the open time of the additive-supply valve, the number of valve actuations (pulses) in a burst of actuations, or various combinations of valve-open durations and number of pulses. Similarly, if the combustion timing was too retarded, the amount of additive supplied would be increased by increasing the valve-open duration, the number of additive pulses, or both (in an embodiment the valve opening clearance could also be adjusted, as discussed previously). It is anticipated that two or more iterations may be required at some conditions to obtain the desired combustion timing; however, feedback and adjustment can be accomplished as fast as once each engine cycle, minimizing the time required to reach the set point at each operating condition.

The magnitude of additive adjustment for a desired combustion-timing change may be obtained from tables or algorithms developed from calibration procedures and stored in the data storage component, particularly for the first adjustment at a new operating condition. For subsequent iterations, the actual change(s) in combustion timing caused by the change(s) in additive for the previous iteration(s) may be used by the processor to more accurately predict the required additional change in additive to produce a given change in combustion timing for rapid convergence to the set point. As the engine operates, combusting fuel to provide power output 780, changes in load and speed may be required, and even for steady load and speed, parameters such as the engine temperature can drift, so the cycle of sensing pressure, computing the combustion timing, and adjusting the amount of fuel additive continues, to keep the combustion timing in acceptable ranges to prevent knock and misfire, and to optimize power or control combustion noise, depending on the particular operating condition and engine application.

In this manner, the closed-loop control system 700 is operable to automatically optimize the combustion timing at various operating conditions through modulating the delivery of the fuel additive, which modulates the autoignition of the fuel/additive mixture in the combustion chamber, and thus the combustion timing.

The closed-loop feedback control system is especially effective for effecting smooth operation through transients in load and speed. In transients, several operating conditions are often changing simultaneously, sometimes over a wide range, making it almost impossible for good control with only a calibration map. However, the closed-loop feedback control system could rapidly adjust (i.e. on a cycle-by-cycle basis if necessary) the amount of additive to maintain good performance (good combustion stability and no knock) through rapid transients.

In an embodiment, the fuel additive is a compound that affects the autoignition reactivity of gasoline (or other combustible fuel, as discussed below) so as to advance or retard the start of combustion. In one embodiment, additives that enhance the autoignition reactivity would be used. These compounds include diesel-fuel ignition improvers, such as, for example, alkyl nitrates, such as 2-ethylhexyl nitrate, isopropyl nitrate, tetra-ethylene glycol dinitrate, organic peroxides, such as di-tert-butyl peroxide, and other reactive compounds such as, for example, neopentane and 2-methoxyethyl ether. In another embodiment, the fuel additive could be a compound that reduces the fuel's autoignition reactivity, for example, methylcyclopentadienyl manganese tricarbonyl (MMT). Tetra-ethyl lead (TEL) would also work to reduce fuel reactivity.

In an embodiment, a fuel additive injection system may include two reservoirs and two additive metering valves. One reservoir and valve is configured for an autoignition improver, and the other reservoir and valve are configured for an autoignition retarder. The processor in this embodiment controls both valves and modulates the addition of the autoignition retarder or improver to control the combustion timing. Although more complex, this embodiment may provide enhanced control over the combustion timing.

In an embodiment, a very small amount of fuel additive is metered to the system, such as, 0.01 to 1.5%, 0.2 to 0.8%, or 0.3 to 0.4% by volume of the fuel-additive mixture.

Depending on the type of engine, the main (majority portion) fuel can have a research octane number (RON) of, for example, 50 to 160, such as, for example 70 to 89, 85 to 93, or 91 to 130. In an embodiment, the fuel stream comprises a high octane fuel with a RON of 80 to 160, and the fuel additive makes the fuel/additive mixture more reactive (i.e. autoignite faster at a given temperature, or have a lower autoignition temperature for a given autoignition delay time) than the high octane fuel alone. In another embodiment, the fuel stream comprises a low-octane fuel with a RON of 20 to 100 and the fuel additive reduces autoignition reactivity of the low-octane fuel. Types of fuels useful with the systems described herein include, but are not limited to: gasoline, diesel fuel, an alcohol fuel, a biofuel, a renewable fuel, a Fischer-Tropsch fuel, a fuel derived from an alcohol (e.g. di-methyl ether), a biofuel, a renewable fuel, or carbon-monoxide, or combinations (blends) thereof.

Although the above description contemplates LTGC engines using GDI fueling primarily, the teachings can also be applied to other fueling systems, such as PFI, used on LTGC engines and to various forms of LTGC, such as HCCI or spark-assisted HCCI/LTGC, using either GDI or PFI fueling. The teachings can also be applied to engines using LTGC-like combustion systems, such as, for example, those termed GCI, PPCI, PCI or PPC, which use diesel-type direct injection fueling, GDI, or direct injectors operating at pressures between those of gasoline and diesel-type direct injectors, or those using a technique termed RCCI which uses two fueling systems, e.g. PFI and diesel-type direct injectors, GDI and diesel-type direct injectors, PFI and GDI, or two GDI injectors. For example, PFI is used on some premixed LTGC (HCCI) systems and is often used for the low-reactivity fuel for the RCCI control method discussed in literature. See e.g., Kokjohn, S., Hanson, R., Splitter, D., and Reitz, R., "Fuel Reactivity Controlled Compression Ignition (RCCI): a Pathway to Controlled High-Efficiency Clean Combustion," *Int. J. Engine Research,* 12:209-226, 2011, doi:10.1177/1468087411401548. Furthermore, diesel-type direct fuel injectors are often used for a low-reactivity fuel with RCCI and with gasoline or a gasoline-like fuel (such as, for example, neat ethanol and ethanol and gasoline blends) for PPCI, PCI or PPC. See, e.g. Manente, V., Tunestal, P., Johansson, B., and Cannella, W., "Effects of Ethanol and Different Type of Gasoline Fuels on Partially Premixed Combustion from Low to High Load," SAE Technical Paper 2010-01-0871, 2010, doi:10.4271/2010-01-0871. Advantages may be obtained in adjusting the fuel reactivity on these systems using the teachings provided herein, for improved operation over the load/speed map. The systems and methods described herein could also be used for conventional diesel and low-temperature diesel combustion, where it might be advantageous to enhance the fuel's autoignition with the autoignition improver at some conditions. For example, a less-expensive, low-cetane number diesel fuel may have its cetane number enhanced by adding controlled amounts of autoignition improver at selected conditions to improve performance. Alternatively, it might be advantageous to decrease the reactivity of diesel fuel for low-temperature diesel combustion using controlled amounts an octane improver such as MMT. Finally, the teachings provided herein might be used for improve operation of SI or stratified SI combustion, particularly under dilute conditions (e.g. using high levels of EGR or fuel-lean operation), that use end-gas autoignition to improve combustion efficiency and reduce emissions. It could also be used to reduce the potential for knock in SI engines at selected conditions by adding an octane improver such as MMT to the fuel, essentially giving an increase in RON or the anti-knock index (AKI) at conditions where it is needed, so that a less expensive lower RON or lower AKI fuel could be used.

In addition to providing a straightforward, direct, combustion-timing control system, using an ignition-enhancing additive to control LTGC facilitates other benefits. In embodiments, higher thermal efficiencies may be obtained compared to the most common control method currently used for LTGC engines, which involves using retained hot residuals to induce autoignition. Besides potentially eliminating the need to revert to SI combustion at high loads, which could allow a higher compression ratio to be used, resulting in higher efficiencies, using the additive will also increase efficiencies because it would reduce combustion temperatures at lower boost conditions and eliminate the need for hot residuals. Even with the higher compression ratios possible when SI combustion for high loads is not required, for naturally aspirated and low-boost operation, current LTGC engines require significant intake heating or a significant amount of hot residuals to be mixed with the fresh reactants to achieve autoignition because of the low autoignition reactivity of gasoline, which results in higher combustion temperatures. However, with the application of an autoignition-enhancing fuel additive, as in the current teaching, autoignition can be achieved with little or no heating, resulting in lower combustion temperatures. This increases the efficiency because lower temperatures result in a higher gamma (specific-heat ratio, $\gamma=c_p/c_v$), which means that more work is extracted during the expansion stroke. Furthermore, gamma is also higher because there is no need for retained hot residuals, which have a low gamma due to the tri-atomic molecules in the combustion-product gases ($CO_2$ and $H_2O$). Finally, with lower charge-gas temperatures, heat transfer losses are likely to be less.

Another benefit of embodiments utilizing the autoignition-enhancing additive is that with the lower autoignition temperatures, the combustion temperatures can be kept well below those that form thermal NOx. For non-additized gasoline, relatively high intake temperatures or residual-gas heating is required at naturally aspirated and low-boost conditions, particularly with the lower compression ratios (e.g. 12:1 or 13:1) used with many current LTGC systems. As a result, combustion temperatures can reach those where significant thermal NOx is formed, and after-treatment is required. Eliminating or reducing the need for heating with the additive reduces thermal NOx well below levels requiring after-treatment. Although some NOx is produced by the combustion of one of the commonly used ignition improvers, 2-ethylhexyl nitrate, amounts are well below those requiring after-treatment.

Cold start and operation at idle and low-loads slightly above idle are other significant challenges for LTGC, HCCI, and other low-temperature combustion concepts such as GCI, PPCI, etc. For control systems using retained hot residuals, the engines are typically started in SI mode, then switch to LTGC, HCCI or GCI using the hot residuals, and at low loads, complex schemes using multiple injections and spark assist are typically required. Techniques such as PPCI, PCI, PPC, and GCI or the dual-fuel RCCI are typically started as a diesel engine on diesel fuel and then switch to gasoline fueling for LTGC as they warm up. Also, low loads can be a challenge for PPCI, PCI, PPC and GCI techniques because it can be difficult to achieve autoignition at these conditions, and hydrocarbon, CO and NOx emissions can be a problem. In embodiments of the systems and methods disclosed herein, however, these problems can be reduced or eliminated because the additive amount can be increased to achieve autoignition of gasoline under low-load and cold engine conditions without a spark plug or the use of diesel fuel, then reduced to lower concentrations when the engine warms up and at higher loads.

In addition to enhancing the autoignition, the additive has been shown to make gasoline autoignition sensitive to the local equivalence ratio ($\phi$-sensitive) at naturally aspirated and low-boost conditions. Without the additive, gasoline is typically $\phi$-sensitive only at higher boost pressures. Being $\phi$-sensitive has the important advantage that partial fuel stratification (PFS) can be used to reduce the combustion heat release rate to allow higher loads without knock and/or to allow the combustion timing to be less retarded at higher loads for higher thermal efficiencies, as disclosed in U.S. Pat. No. 8,689,767 and U.S. Pat. No. 7,128,046. Thus, in embodiments of the present systems and methods, PFS could be applied over a wider portion of the operating map (in particular at naturally aspirated and low-boost conditions, where gasoline is not typically $\phi$-sensitive (equivalence ratio)), with important benefits for higher efficiencies and higher loads for a given intake pressure.

Finally, the application of the systems and methods disclosed herein is not limited only to ignition modifiers for LTGC, diesel or other compression-ignition engines. The high-speed piezoelectric valve and mixing system could also be applied to quickly inject other types of fuel additives for which there might be advantages to adjusting the quantity over the engine operating map. Some potential examples include an octane improver (which makes the fuel harder to autoignite) for SI engines or a lubricity improver.

Various functions described herein, particularly those associated with analysis of sensor signals to determine control parameters, determining errors and adjustment of additive supply-valve control signals and synchronization with control of the main fuel injection, can, for example, be implemented in software for the digital processor (i.e. computer), which may be the ECU. However, dedicated electronic hardware, such as specialized electronic circuits and/or logic components might also be used, or various combinations of software for the processor and dedicated hardware components. If implemented in software (or for the parts implemented in software), the functions can be stored on, or transmitted over as one or more instructions or code on, a computer-readable medium. Computer-readable media includes computer-readable storage media. A computer-readable storage media can be any available storage media that can be accessed by a computer. By way of example, and not limitation, such computer-readable storage media can comprise RAM, ROM, EEPROM, CD-ROM or other optical disk storage, magnetic disk storage or other magnetic storage devices, (including storage devices networked and accessed over the internet such as through the "cloud") or any other medium that can be used to carry or store desired program code in the form of instructions or data structures and that can be accessed by a computer. Further, in an example, a propagated signal is not included within the scope of computer-readable storage media. Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), and Complex Programmable Logic Devices (CPLDs).

All patents, patent applications, publications, technical and/or scholarly articles, and other references cited or referred to herein are in their entirety incorporated herein by reference to the extent allowed by law. The discussion of those references is intended merely to summarize the assertions made therein. No admission is made that any such patents, patent applications, publications or references, or any portion thereof, are relevant, material, or prior art. The right to challenge the accuracy and pertinence of any assertion of such patents, patent applications, publications, and other references as relevant, material, or prior art is specifically reserved.

In the description above, for the purposes of explanation, numerous specific details have been set forth in order to provide a thorough understanding of the embodiments. It will be apparent however, to one skilled in the art, that one or more other embodiments may be practiced without some of these specific details, or with some alternative detailed procedures or apparatus, as mentioned or alluded to above. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated among the figures to indicate corresponding or analogous elements, which may optionally have similar characteristics.

It should be appreciated that the terms "a," "an," and "the" should be interpreted to mean "one or more," unless the context clearly indicates to the contrary, and the term "or" is not meant to be an exclusive "or," unless the context clearly indicates to the contrary. It should also be appreciated that reference throughout this specification to "one embodiment", "an embodiment", "another embodiment", "other embodiment", "one or more embodiments", or "different embodiments", for example, means that a particular feature may be included in the practice of the invention. Similarly, it should be appreciated that in the description, various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

It is claimed:

1. A method for controlling the timing of combustion in an internal combustion engine, comprising:

actuating a fast-acting fuel-additive supply valve to meter an amount of fuel additive into a fuel stream conduit, thereby forming an additive-enhanced fuel;

delivering the additive-enhanced fuel directly or indirectly into a combustion chamber, an intake port, or intake manifold;

mixing the fuel additive with fuel in the fuel stream conduit with a mixing system, wherein the mixing system and fuel stream conduit are different structures; and combusting the additive-enhanced fuel;

wherein the fast-acting fuel-additive supply valve is actuated in a series of one or more pulses during each engine cycle to meter the amount of additive into the fuel.

2. The method of claim 1 wherein the fast-acting fuel-additive supply valve is a piezoelectric-actuated valve.

3. The method of claim 1, further comprising controlling the timing of combustion in the internal combustion engine by controlling an amount of the fuel additive supplied to the fuel stream conduit by varying an open-shut timing of the fast-acting fuel-additive supply valve, by varying an opening clearance of the fast-acting fuel-additive supply valve, or both.

4. The method of claim 1 further comprising:

controlling the timing of combustion in the internal combustion engine by controlling an amount of the fuel additive supplied to the fuel stream conduit by varying an open-shut timing of the fast-acting fuel-additive supply valve combined with a flow-restricting orifice; or controlling the timing of combustion in the internal combustion engine by controlling the open-shut timing of an additive supply valve that has a maximum opening clearance that restricts the flow of the fuel additive.

5. The method of claim 1 wherein the fuel stream conduit comprises a high-octane fuel with a RON of 80 to 160, and the fuel additive is 2-ethylhexyl nitrate, di-tert-butyl peroxide, isopropyl nitrate, tetra-ethylene glycol dinitrate, neopentane, 2-methoxyethyl ether, or other autoignition enhancing additive.

6. The method of claim 1 wherein the fuel stream conduit comprises a low-octane fuel with a RON of 20 to 100 and the fuel additive reduces autoignition reactivity of the low-octane fuel.

7. The method of claim 1 further comprising mixing the fuel additive with fuel in the fuel stream conduit with a static mixing system, wherein the static mixer includes shaped baffles or other flow obstacles or channels to enhance mixing.

8. The method of claim 1 further comprising mixing of the fuel additive with fuel in the fuel stream conduit with an active mixing system.

9. The method of claim 1 wherein an amount of additive metered into the fuel stream conduit by the fast-acting fuel-additive supply valve is adjusted as frequently as each time the step of injecting the additive-enhanced fuel is performed, in order to maintain a desired combustion timing, wherein the number of additive pulses per fuel injection event is about 1 to about 20.

10. The method of claim 1 wherein the fuel additive is metered into the fuel stream conduit 12 inches or less from a fuel injector that is coupled to the engine.

11. The method of claim 1 wherein the fast-acting additive-supply valve and mixing system are built into the body of an injector that is coupled to the engine.

12. The method of claim 1 wherein a processor controls actuating the fuel-additive supply valve to meter the fuel additive into the fuel stream conduit.

13. The method of claim 12 wherein the processor is in communication with an engine control unit, or an engine control unit comprises the processor, and the method further comprises synchronizing the metering of the fuel additive into the fuel stream conduit with the step of injecting the additive-enhanced fuel.

14. The method of claim 12 wherein the processor is operable to execute instructions to adjust the amount of fuel additive metered into the fuel stream conduit based on input from a device that produces a signal that can be analyzed to determine the combustion timing.

15. The method of claim 12, wherein the processor is operable to execute instructions to adjust the amount of fuel additive metered into the fuel stream conduit based on a calibration map, or a combination of the calibration map and the measured combustion timing, as determined from a device that produces a signal that can be analyzed to determine the combustion timing.

16. The method of claim 12, wherein the processor is operable to execute instructions to dynamically adjust an amount of fuel additive metered into the fuel stream conduit to dynamically adjust combustion timing of the engine as the engine traverses an operating map, so that at least 98% of the time the combustion timing of the engine is maintained within three crank-angle degrees or less of either a predetermined value or a value based on a combustion timing calculated to avoid the onset of knock or misfire, as determined by an analysis of a cylinder-pressure signal or a knock sensor signal for each operating condition on the operating map.

17. The method of claim 1 where the fuel additive is supplied to the fast-acting valve with a pressure that is 1 to 100 bar above the pressure of the fuel stream conduit into which the additive will be metered.

18. A combustion timing control system for an internal combustion engine comprising:

a pressurized fuel-additive reservoir a fast-acting fuel-additive supply valve;

a fuel-stream conduit;

a fuel injector;

a mixing system for mixing a fuel additive with fuel in the fuel-stream conduit; and a processor;

the fast-acting fuel-additive supply valve meters the fuel additive in a series of one or more pulses during each engine cycle from the pressurized fuel-additive reservoir into the fuel-stream conduit upstream of the fuel injector or directly into the fuel injector, the fast-acting fuel-additive supply valve being controlled by the processor;

wherein the mixing system and fuel stream conduit are different structures.

19. The method of claim 1, wherein the internal combustion engine is a low temperature gasoline combustion engine, a homogeneous charge compression ignition engine, a gasoline compression ignition engine, a partially premixed compression ignition engine, a spark-assisted version or a plasma-igniter-assisted version of any of these engines.

20. A method for controlling the timing of combustion in an internal combustion engine, comprising:

actuating a fast-acting fuel-additive supply valve to meter an amount of fuel additive into a fuel stream conduit, thereby forming an additive-enhanced fuel;

mixing the fuel additive with fuel in the fuel stream conduit with a mixing system, wherein the mixing system and fuel stream conduit are different structures;

after mixing, delivering the additive-enhanced fuel directly or indirectly into a combustion chamber, an intake port, or intake manifold and combusting the additive-enhanced fuel;

wherein an amount of additive metered into the fuel stream conduit by the fast-acting fuel-additive supply valve is adjusted as frequently as each time the step of injecting the additive-enhanced fuel is performed to maintain a desired combustion timing, and the number of additive pulses per fuel injection event is about 1 to about 20, and a pulse duration for the additive pulses is about 70 to about 500 microseconds;

wherein a processor controls actuating the fast-acting fuel-additive supply valve to meter the fuel additive into the fuel stream conduit 12 inches or less from a fuel injector or in a fuel injector that is coupled to the engine and the processor is operable to execute instructions to adjust the amount of fuel additive metered into the fuel stream conduit based on input from a device that produces a signal that can be analyzed to determine the combustion timing;

wherein the internal combustion engine is a low temperature gasoline combustion engine, a homogeneous charge compression ignition engine, a gasoline compression ignition engine, a partially premixed compression ignition engine, a spark-assisted version of any of these engines, or a plasma-igniter-assisted version of any of these engines.

* * * * *